US007955163B2

(12) United States Patent
Kozak et al.

(10) Patent No.: US 7,955,163 B2
(45) Date of Patent: Jun. 7, 2011

(54) ABRADING DEVICE

(75) Inventors: Ira Kozak, Riverwoods, IL (US); Burton Kozak, Chicago, IL (US)

(73) Assignee: Combined Products Co. #1, Inc., Chicago, IL (US)

( * ) Notice: Subject to any disclaimer, the term of this patent is extended or adjusted under 35 U.S.C. 154(b) by 1069 days.

(21) Appl. No.: 11/800,057

(22) Filed: May 3, 2007

(65) Prior Publication Data

US 2008/0274676 A1 Nov. 6, 2008

(51) Int. Cl.
*B24D 17/00* (2006.01)

(52) U.S. Cl. ..... 451/495; 451/518; 451/519; 451/521; 451/522; 451/524; 451/525

(58) Field of Classification Search ..... 451/344, 451/490, 495, 513, 514, 518, 519, 521, 522, 451/524, 525

See application file for complete search history.

(56) References Cited

U.S. PATENT DOCUMENTS

| | | | | | |
|---|---|---|---|---|---|
| 2,132,889 | A * | 10/1938 | Ayres | 132/76.5 |
| 3,871,141 | A * | 3/1975 | Bonapace | 451/524 |
| 3,874,126 | A * | 4/1975 | Catlin et al. | 451/525 |
| 4,154,026 | A * | 5/1979 | Palthe | 451/493 |
| 4,206,574 | A * | 6/1980 | Dotsko | 451/495 |
| 4,377,057 | A * | 3/1983 | Pincha | 451/491 |
| 4,977,712 | A * | 12/1990 | Fisher et al. | 451/510 |
| 4,991,361 | A * | 2/1991 | Huppert et al. | 451/464 |
| 5,706,835 | A * | 1/1998 | Salvino | 132/75.6 |
| D402,408 | S * | 12/1998 | Salvino | D28/59 |
| D414,900 | S * | 10/1999 | Salvino | D28/59 |
| 5,980,370 | A * | 11/1999 | Chang | 451/344 |
| 6,283,842 | B1 * | 9/2001 | Collins | 451/495 |
| 6,733,376 | B2 * | 5/2004 | Williams | 451/344 |
| 2007/0077875 | A1 * | 4/2007 | Pontieri | 451/495 |

* cited by examiner

*Primary Examiner* — Eileen P. Morgan
(74) *Attorney, Agent, or Firm* — Factor & Lake, Ltd.

(57) ABSTRACT

An abrading device features a flexible abrading membrane supported by two supports. The device may be used in either linear or rotary configurations. The device can be used in conjunction with devices that impart continuous or vibratory linear or rotary motion.

20 Claims, 11 Drawing Sheets

Fig. 6a
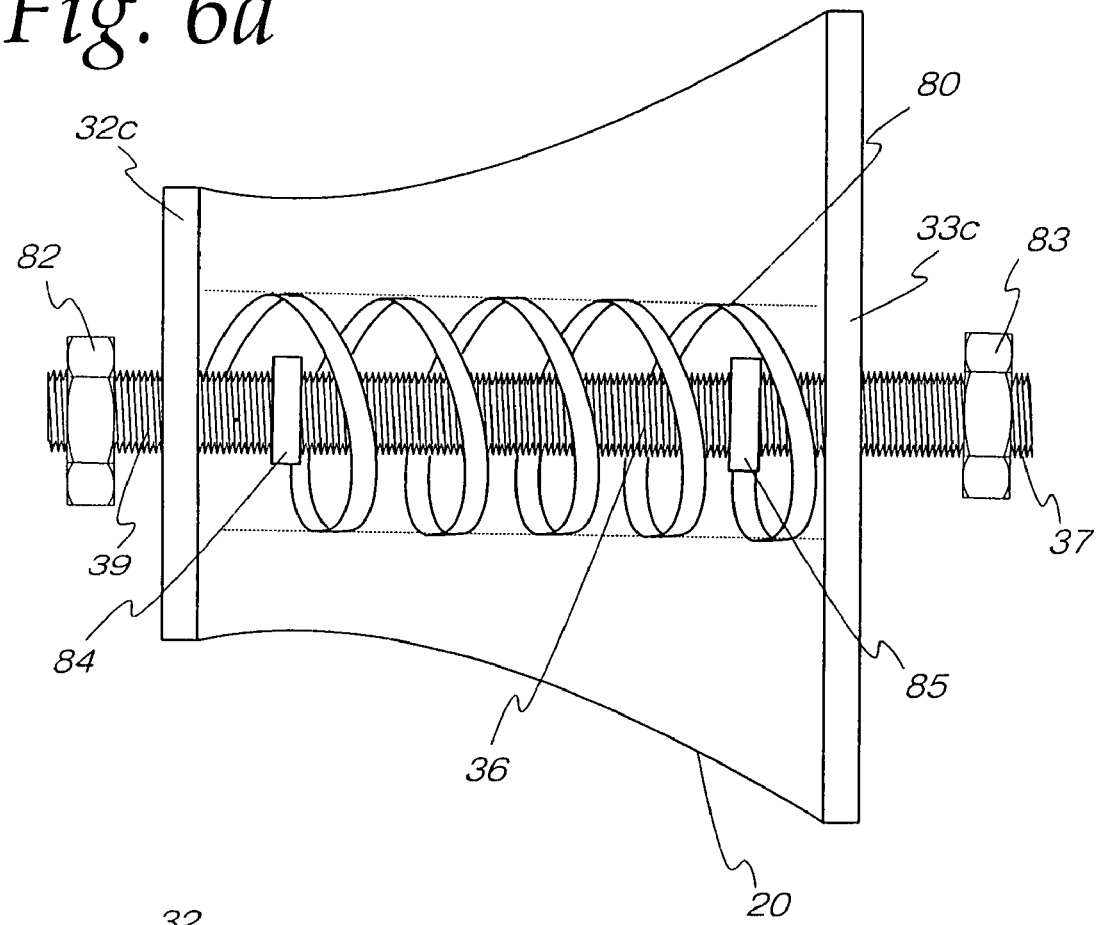
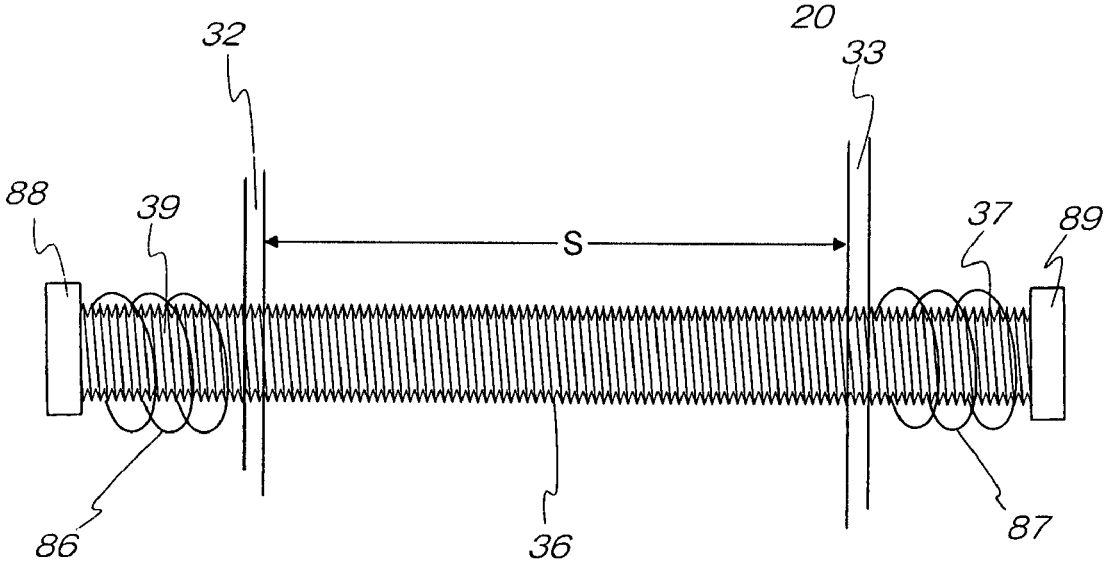
Fig. 6b

ABRADING DEVICE

BACKGROUND OF THE INVENTION

1. Field of the Invention

This invention relates to the field of abrading devices, including sanding and polishing devices and, more particularly, this invention relates to devices adapted to the abrading, sanding, and polishing of one or more curved surfaces.

2. Background of the Invention

Abrading, sanding, and polishing devices have long been developed for use with flat surfaces, especially for use in conjunction with power tools. But many such devices are ill-suited for use in conjunction with curved surfaces. Some devices allow the sanding and polishing of curved surfaces only by treating the curved surface as a series of flat surfaces tangent to a specific curve. This is the case with belt- or disk-sanders and polishers. U.S. Pat. No. 6,722,961 ("Polishing Machine for Wheel Rims") awarded to Solanellas in 2004 constitutes an example of this approach.

Other sanders/polishers are brush-type devices. These devices accommodate curved surfaces only by applying more force on protruding portions of the surface and less force on the remainder. Typical brush-type devices are disclosed in U.S. Pat. No. 4,106,193 ("Rotary Scraper with Non-Gouging Finger Array") awarded to Fisher et al. in 1978 and in U.S. Pat. No. 5,119,601 ("Apparatus for Abrading a Surface") awarded to Yamashita et al. in 1992. One drawback of such devices is that they can engage only surfaces of very shallow depth or relief (i.e. they are limited in their use to a fraction of the height of the bristles).

A need exists in the art for a device that would allow abrading, sanding, and polishing of curved surfaces, including power-assisted abrading, sanding, and polishing of curved surfaces. The device should also provide a means to abrade a variety of surface shapes and dimensions.

SUMMARY OF THE INVENTION

An object of this invention is to provide a device for abrading, sanding, and polishing curved surfaces that overcomes many of the disadvantages in the prior art.

Another object of this invention is to provide a device for abrading, sanding, and polishing curved surfaces that allows work on a variety of surface shapes. A feature of this invention is an abrading substrate with an adjustable shape. An advantage of this invention is that it allows an operator to configure the shape of the abrading surface to the shape of the surface to be abraded during the actual abrading process.

Yet another object of this invention is to provide a device for power-assisted abrading, sanding, and polishing of curved surfaces that allows rapid change in the work done on a given surface. A feature of this invention is the use of an abrading substrate that can quickly be replaced by another substrate. An advantage of this invention is that it allows an operator to quickly change the task being performed (e.g. from sanding to polishing).

In brief, this invention provides an abrading device for curved workpieces that features interchangeable abrading surfaces which conform to the shape of the workpiece to be abraded during the abrading action itself.

Also provided is an abrading device comprising a substrate defining a rough surface, wherein the substrate has a first end and a second end; a first support attached to the first end; a second support attached to the second end, wherein the second support is movable relative to the first support; and a means for imparting motion to the first support and the second support relative to a workpiece.

BRIEF DESCRIPTION OF THE DRAWING

The foregoing and other objects, aspects and advantages of this invention will be better understood from the following detailed description of the preferred embodiments of the invention with reference to the drawing, in which:

FIG. 6*a* is a schematic view of a spring biasing arrangement for a device for abrading, sanding, and polishing curved surfaces, in accordance with features of the present invention;

FIG. 6*b* is a schematic view of an alternative spring biasing arrangement for a device for abrading, sanding, and polishing curved surfaces, in accordance with features of the present invention;

DETAILED DESCRIPTION OF THE INVENTION

The present invention provides an improved device for abrading, sanding, and polishing curved surfaces which overcomes disadvantages in the prior art. The present invention features interchangeable abrading surfaces with an adjustable shape that can be configured to the shape of the surface to be abraded. The invention facilitates conformation of the sanding surface to the workpiece during sanding or polishing. The invented device can be used either manually or in conjunction with a power tool.

The invented tool provides a continuously variable abrading surface. This allows for the thorough cleaning, sanding, cutting, shaping, and deburring of surfaces having varying contours. Any radius of curvature for the workpiece surface is accommodated with the invented tool given the ability of its abrading surface to contour and match with the topography (e.g., diameter) of the work piece.

Figure 1A:
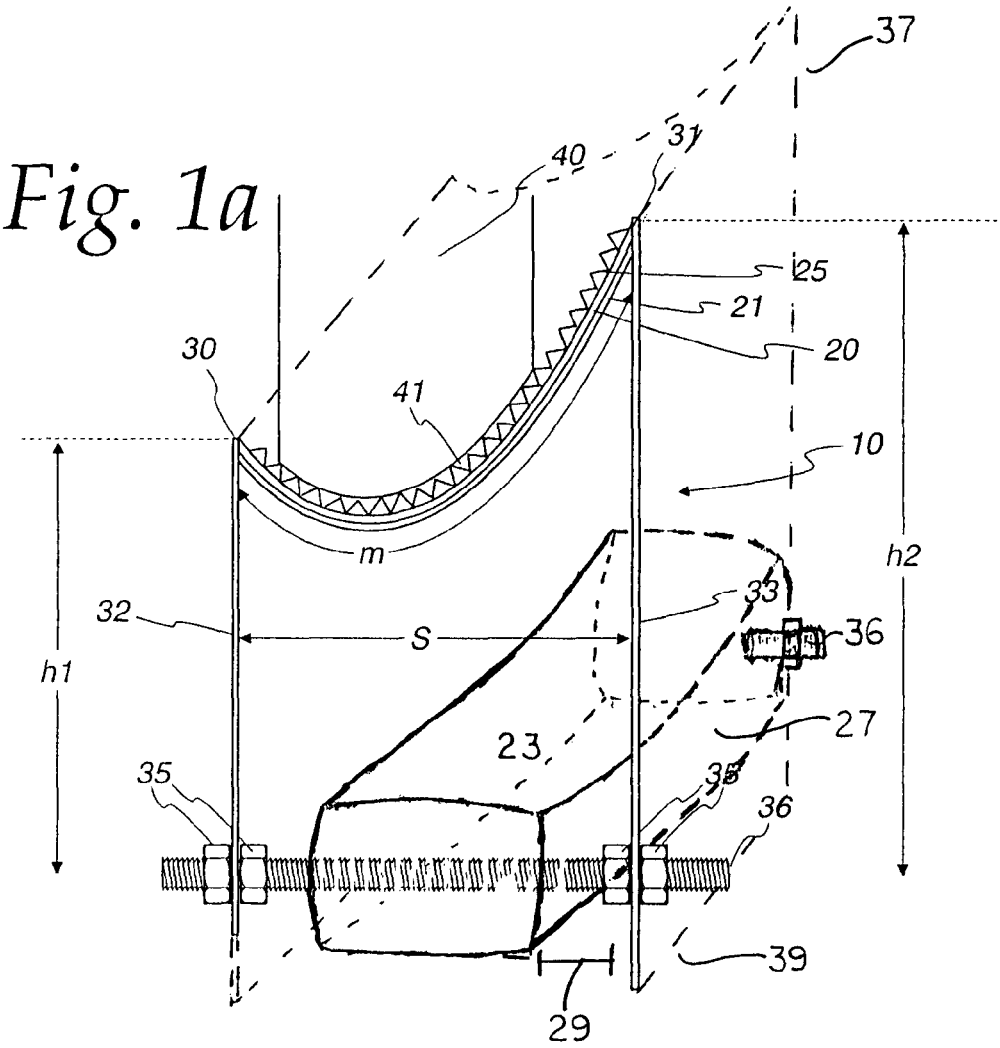
FIG. 1*a* is an overall schematic perspective view of an exemplary embodiment of a device for abrading, sanding, and polishing of linearly-extending curved surfaces, in accordance with features of the present invention.
Figure 1B:
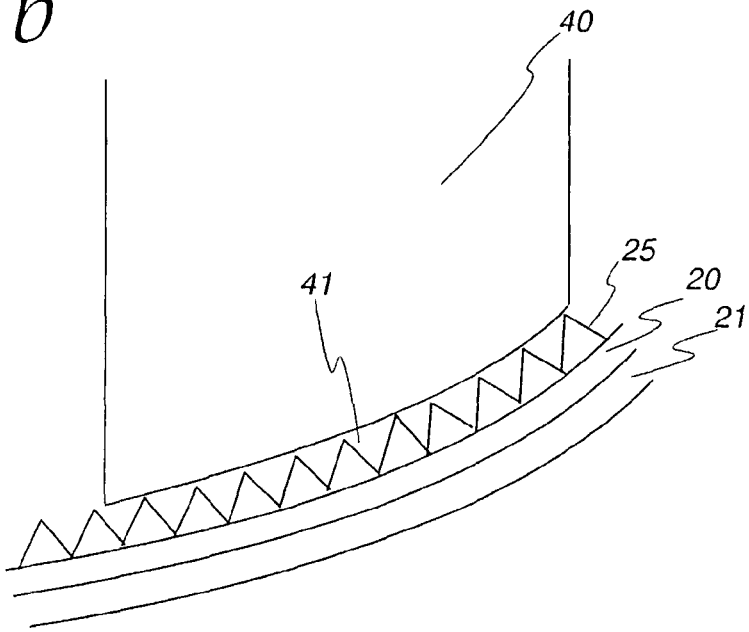
FIG. 1*b* is a detail of a schematic profile view of an exemplary embodiment of a device for abrading, sanding, and polishing of linearly-extending curved surfaces, in accordance with features of the present invention.

FIG. 1*a* is an overall schematic perspective view of an exemplary embodiment of the invention. As depicted in FIG. 1*a*, the invented device 10 comprises a preferably flexible membrane substrate 20 removably affixed to the edges 30 and 31 of supports 32 and 33. The supports are plates that are held in place by means such as threaded nuts 35 tightened on one or more threaded rods 36 (or, in the alternative, on a plurality of rods 36 defining a plane perpendicular to the supports 32, 33 and the plane of the drawing). The supports each define a first plane and a second plane. Preferably, but not necessarily, these supports or plates 32, 33 are parallel to each other. The rods 36 transversely extend through the plates so as to define a gap or separation "S" between the plates. The separation S between the supports 32, 33 may be fixed or may be made adjustable. The substrate 20 spans the gap between the plates 32, 33 and is attached along substantially the entire edge of each plate. Deposited on the substrate 20 is an abrading medium 25. FIG. 1*a* depicts a workpiece 40 with a curved surface 41. (See detail in FIG. 1*b*) The membrane 20 can be made to conform to the shape of the curved surface 41 by appropriate choices of the length m of the membrane 20, of the separation S between the plates 32 and 33, and/or of the difference between the dimensions of the supports. The difference in the distance h1 of the edge 30 from the edge of the first support 32 to the axis of the rod 36 compared to the distance h2 of the edge 31 from the edge of the second support 33 to the axis of the rod 36 will affect the topography of the abrading substrate.

The device is provided with means to impart motion to the supports 32 and 33 relative to the workpiece 40. In the embodiment depicted in FIG. 1*a*, the supports 32, 33 move in tandem, the supports experiencing identical linear velocities as they are driven by such means as a handle 23 removably positioned on the tool 10. The handle is removably attached to the supports and intermediate to the supports 32, 33, at a region of the supports which are opposite the distal end 37 of the tool 10.

In one embodiment, the handle H is attached by means of a plurality of the rods 36 discussed supra, the rods transversely extending through the supports 32, 33. Longitudinally extending sides 27 of the handle 23 are positioned medially from inward-facing surfaces of the supports 32, 33 so as to provide a space 29 on either or both sides of the longitudinally extending sides 27 of the handle, the space adapted to receive the fingers of a user who wraps his hand about the circumference of the handle to grasp the handle. As such, the user manipulates the tool 10 by grasping its proximal end Alternatively, the supports 32, 33 may be held fixed on a workbench and the workpiece 40 moved with respect to them. (See FIGS. 3*a*, 3*b*, and 3*c*) In an alternative embodiment, the supports 32, 33 are circular plates that also move in tandem rotating around a rod 36, the supports experiencing identical angular velocities, the rotational motion being driven by a rotary power tool with a chuck to which the rod 36 is attached (See FIG. 2*b*).

As more fully discussed infra, the topography of the abrading substrate is also varied by the user applying axial and radial forces to the device during use.

Where the abrading membrane 20 is formed from a relatively flimsy material such as paper, a flexible but sturdy foundation membrane 21 in contact with the abrading membrane 20 may be used. Abrasion is accomplished by relative motion between the work surface 41 and the abrading membrane 20.

Figure 2A:
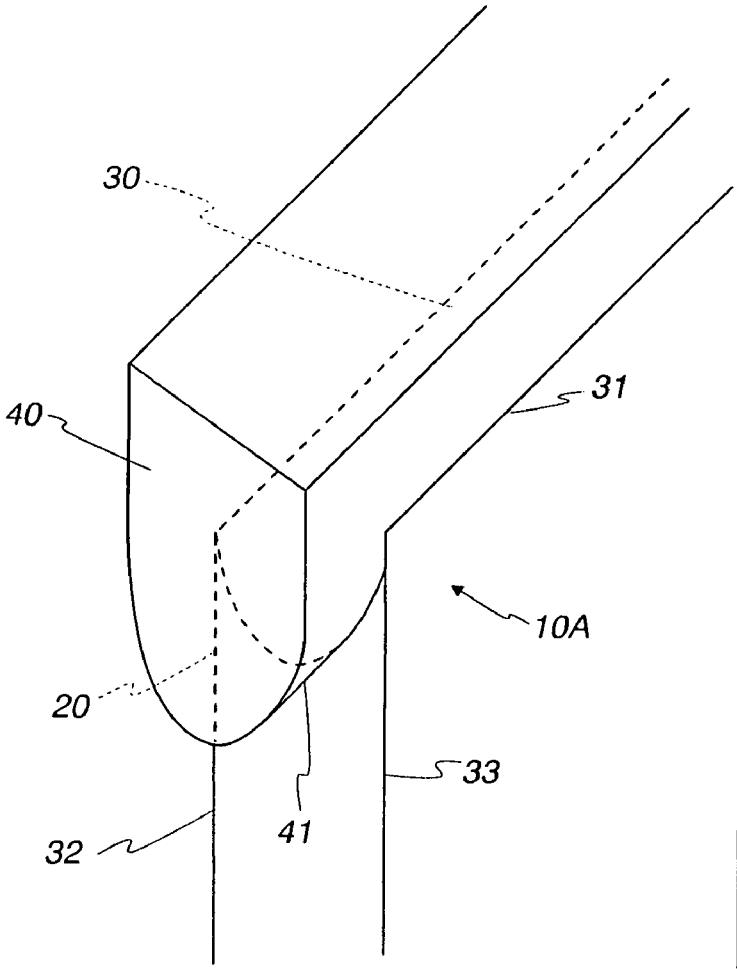
FIG. 2*a* is a schematic perspective view of an exemplary embodiment of a linear device for abrading, sanding, and polishing curved surfaces, in accordance with features of the present invention.
Figure 2B:
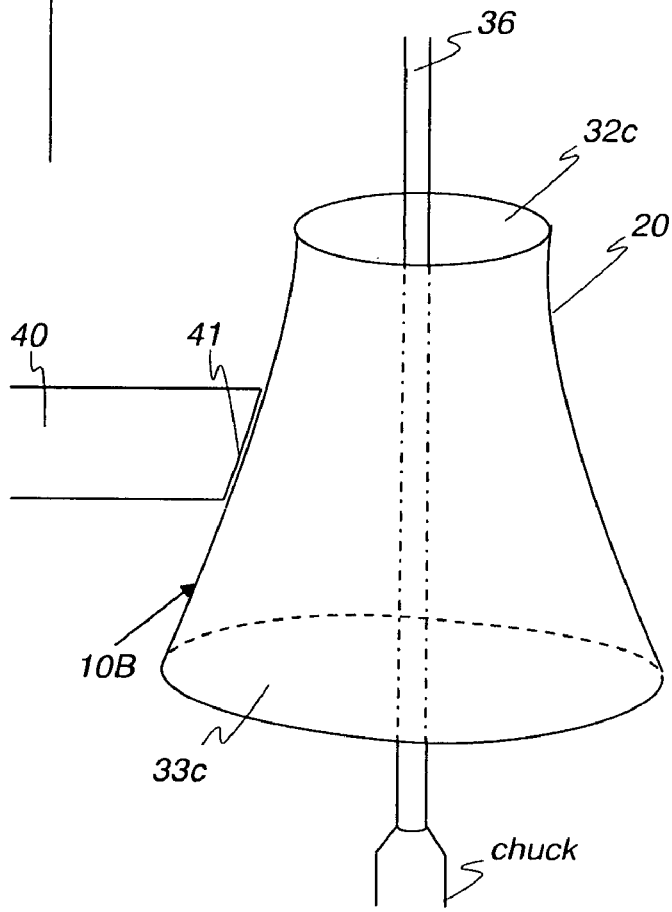
FIG. 2*b* is a schematic perspective view of an exemplary embodiment of a rotary device for abrading, sanding, and polishing of asymmetrical curved surfaces, in accordance with features of the present invention.

Two general embodiments are envisioned for the abrading device. FIG. 2*a* depicts an embodiment where the abrading device forms a rectilinear trough 10A while FIG. 2*b* depicts a rotary device 10B where the plates 32 and 33 are co-axial circular disks 32*c* and 33*c*. The disks are positioned in a pre-determined spatial relationship to each other via a coupling rod 36 situated along an axis of the device 10B and intermediate the two disks. Several types of motion of the workpiece 40 and/or the abrading device can be accommodated with either embodiment of the present invention.

Linear Sanding Device.

Figure 3A:
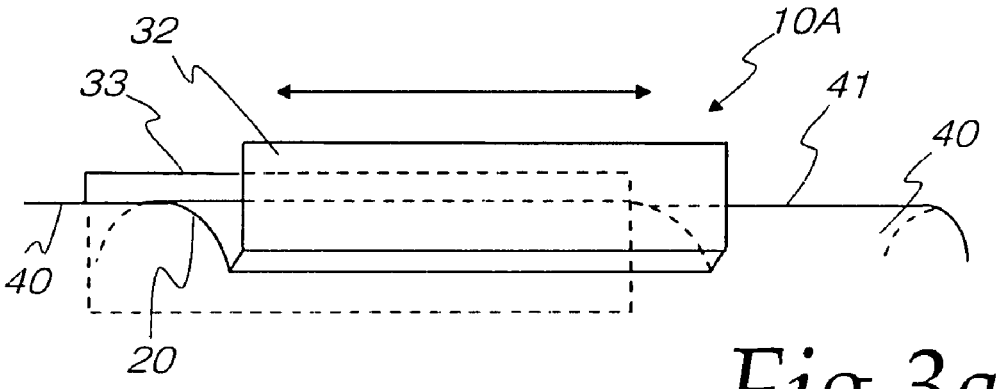
FIG. 3*a* is a schematic view of a mode of operation of a linear device for abrading, sanding, and polishing curved surfaces, in accordance with features of the present invention.
Figure 3B:
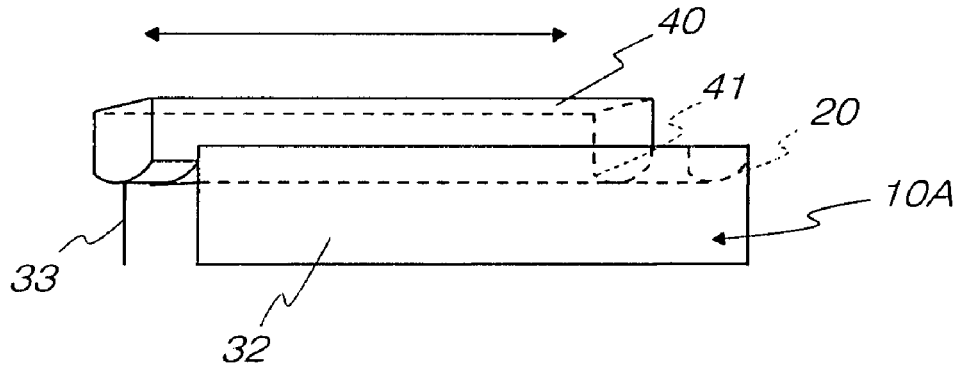
FIG. 3*b* is a schematic view of an alternative mode of operation of a linear device for abrading, sanding, and polishing curved surfaces, in accordance with features of the present invention.
Figure 3C:
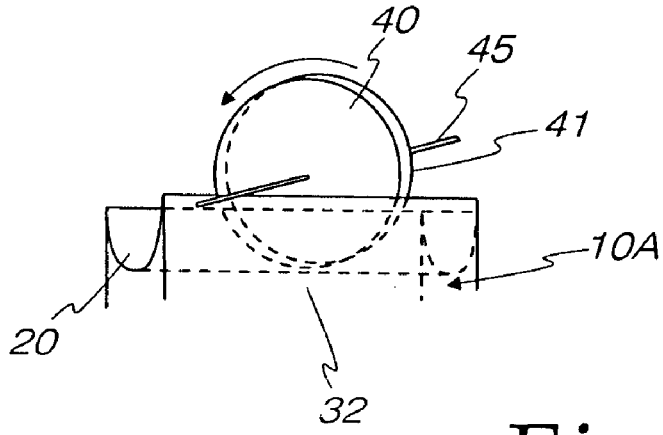
FIG. 3*c* is a schematic view of an alternative mode of operation of a linear device for abrading, sanding, and polishing curved surfaces, in accordance with features of the present invention.

FIGS. 3*a* through 3*c* illustrate possible uses of the rectilinear embodiment. FIG. 3*a* depicts an arrangement where the workpiece 40 is a stationary rectilinear rail and the abrading device 10A is a skate moving back and forth and adapted to abrade longitudinally extending surfaces of the rail. FIG. 3*b* depicts a converse arrangement where the workpiece 40 is a rectilinearly moving elongated object that is made to move back and forth over the membrane 20 while the abrading device 10A is stationary.

FIG. 3*c* depicts a situation where the workpiece 40 is axially symmetric and rotating around an axial shaft 45 while it remains in contact with the abrading membrane 20 of the abrading device 10A. There are two possible arrangements in conjunction with FIG. 3*c*: (1) the abrading device 10A is stationary while the rotating workpiece 40 travels back and forth along the trough of the device 10A at the same time as it rotates around the shaft 45 along the axis of the workpiece (said rotation of the shaft being driven by a milling machine, a lathe, a hand drill, or any other torque imparting device) and (2) the workpiece 40 is rotating at a fixed position while the abrading device is moving back and forth. Of course (1) and (2) can be combined.

In all three of the above FIGS. 3*a* through 3*c*, relative motion between the trough device 10B and the workpiece 40 can be accomplished either with a motor (for instance, with the abrading device 10A being transported on the bed of a milling machine) or by hand. Also, in each of the cases described in FIGS. 3*a* through 3*c*, the motion described can be supplemented with vibratory motion.

Figure 4A:
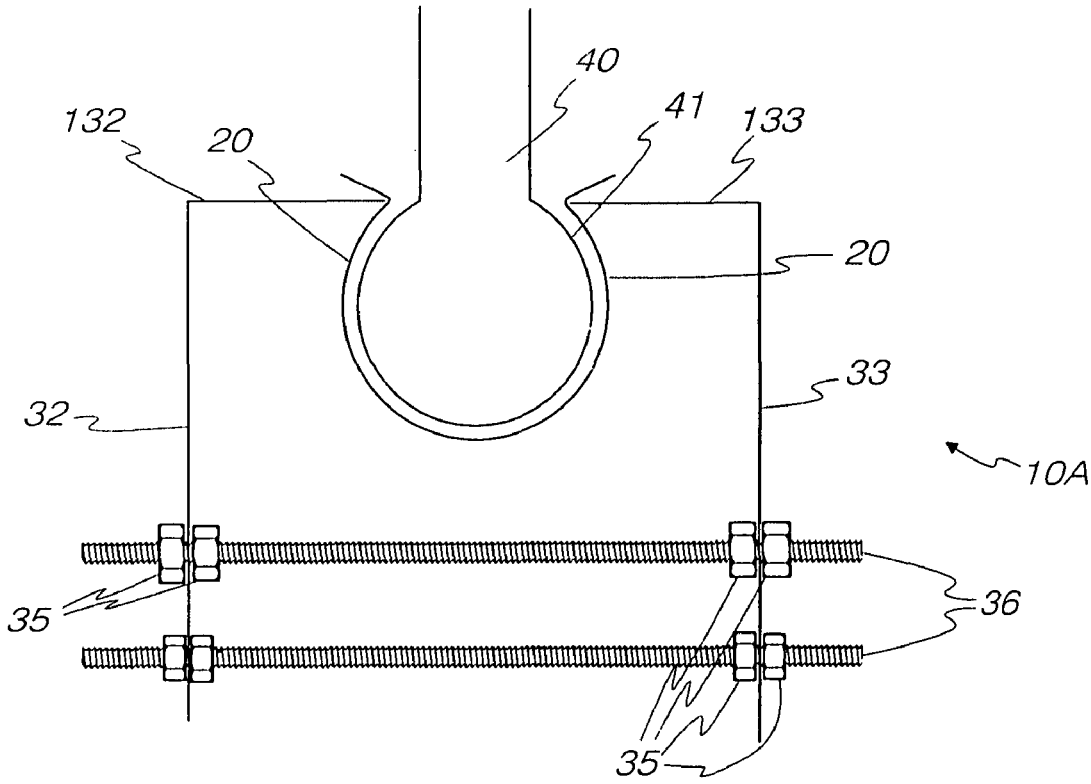
FIG. 4*a* is a schematic view of an alternative embodiment of a linear device for abrading, sanding, and polishing curved surfaces, in accordance with features of the present invention.

FIG. 4*a* depicts a modified linear trough device where the abrading substrate 20 is draped over overhanging shoulders 132, 133. This arrangement allows the abrading of rectilinearly extending workpieces the cross-section of which is not uniformly decreasing.

Figure 4B:
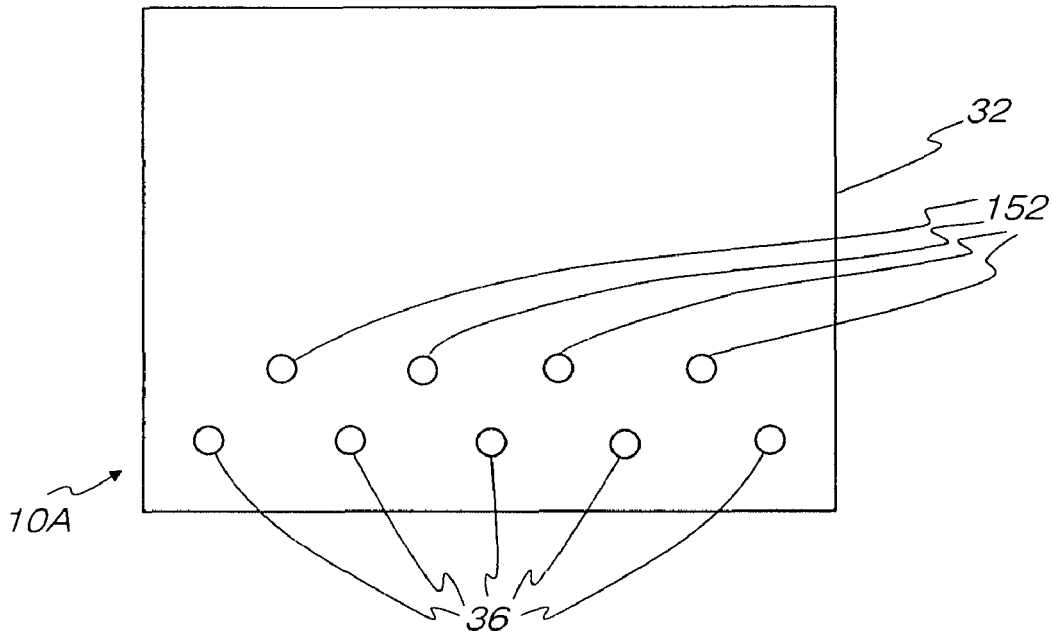
FIG. 4*b* is a schematic view of another alternative embodiment of a linear device for abrading, sanding, and polishing curved surfaces, in accordance with features of the present invention.

Also, while a planar array of rods 36 is depicted in FIG. 1*a*, additional rigidity can be conferred to a trough device 10A if additional rods 152 parallel to the rods 36 but not coplanar therewith connect the plates 32 and 33, as shown schematically in FIG. 4*b*.

Figure 4C:
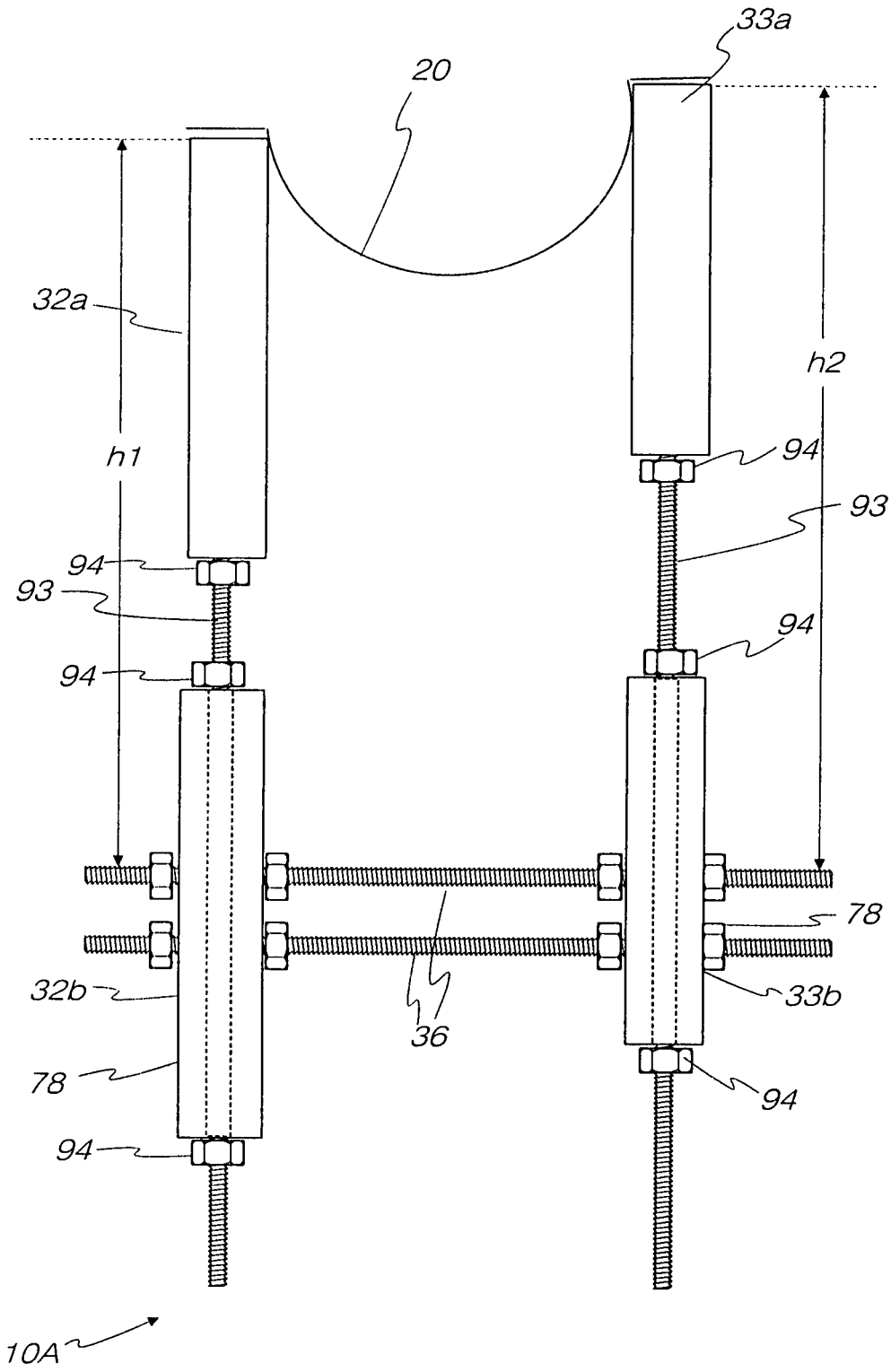
FIG. 4*c* is a schematic view of another alternative embodiment of a linear device for abrading, sanding, and polishing curved surfaces, in accordance with features of the present invention.

FIG. 4*c* depicts a modification of the linear device 10A wherein either or both heights h1 and h2 are continuously adjustable. As shown in FIG. 4*c*, the supports 32, 33 each comprise two plates, 32*a* and 32*b* to adjust the dimension of support 32 and 33*a* and 33*b* to adjust the dimension of support 33. Both supports also comprise means to adjust the distance between their component plates. An exemplary embodiment depicted in FIG. 4*c* comprises bores 78 in plates 32*b* and 33*b*, said bores orthogonal to, but not coplanar with, the rods 36. The bores are adapted to receive threaded rods 93 that are permanently secured to the plates 32*a* and 33*a* and slidably secured to the plates 32*b* and 33*b* by means of nuts 94. This embodiment has the added advantage of allowing a quick interchange of abrading membranes 20 already secured their respective plates 32*a* and 33*a* without altering the separation between the supports 32 and 33. One or more threaded rods 36 allow the adjustment of the spacing between the supports 32, 33.

Rotary Sanding Device

Figure 5A:
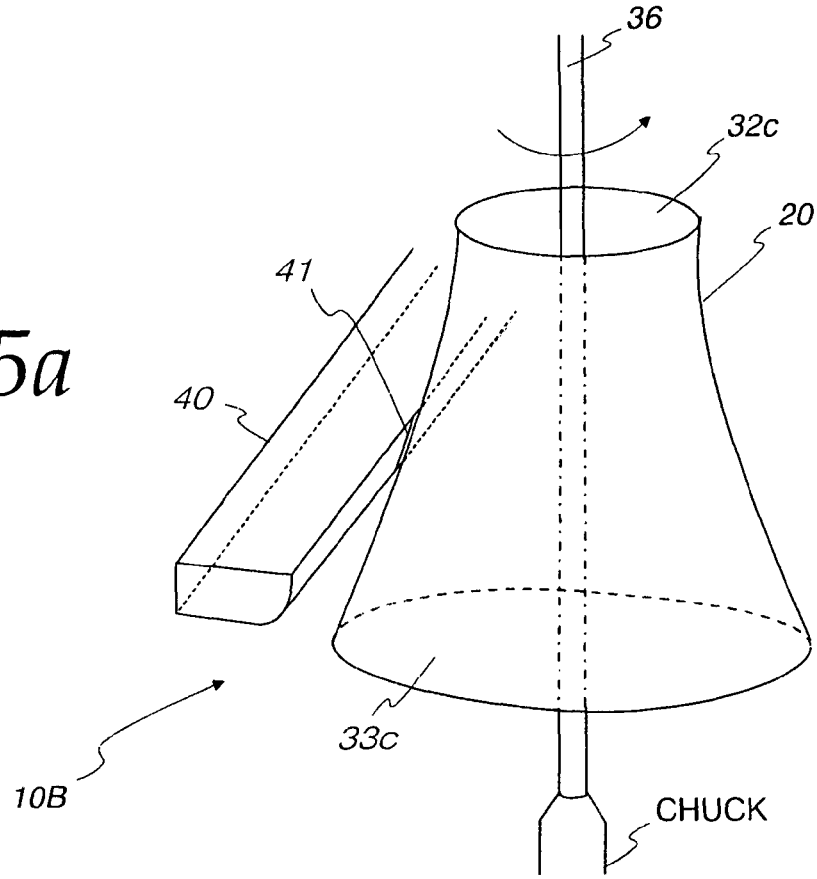
FIG. 5*a* is a view of a mode of operation of a rotary device for abrading, sanding, and polishing curved surfaces, in accordance with features of the present invention.

FIG. 5*a* depicts an arrangement where the workpiece 40 is a rail and the abrading device 10B is a rotary device where the plates 32 and 33 define co-axial circular disks 32*c* and 33*c* and the plate coupling rod 36 constitutes the axis of rotation of the device. The rotary device can be made to move back-and-forth on the rail as torque is imparted to the axial shaft 36 of the device or the position of the rotary device may remain stationary while the workpiece is transported with respect to it.

The rotary abrading device 10B may be used with a wide variety of workpiece shapes especially when the axial shaft 36*c* is driven by a hand-held torque-imparting device such as an electric drill or an impact driver.

Figure 5B:
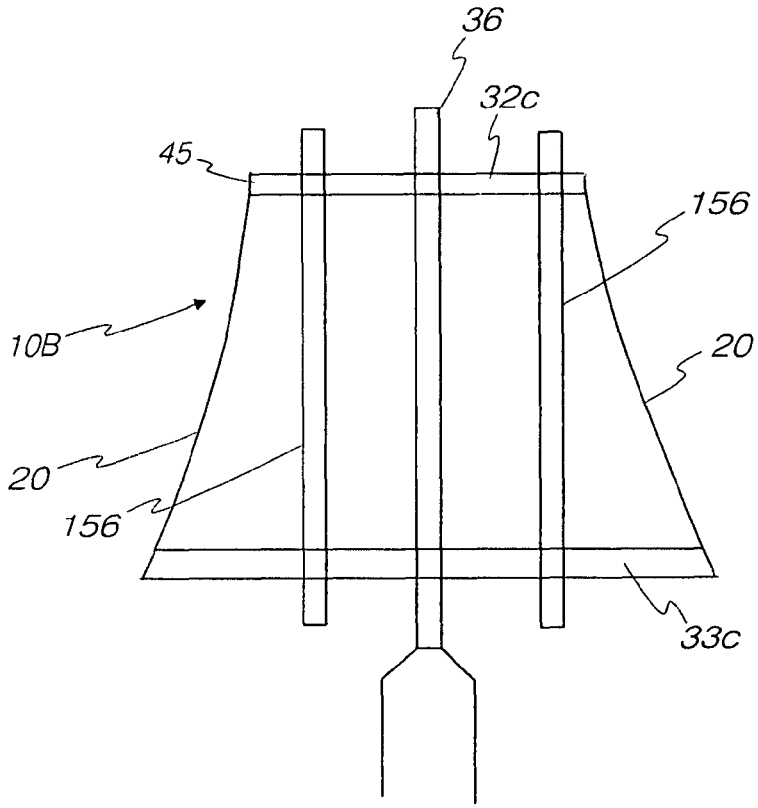
FIG. 5*b* is a schematic view of an alternative embodiment of a rotary device for abrading, sanding, and polishing curved surfaces, in accordance with features of the present invention.

While a single rod 36 is depicted in FIG. 5*a*, additional rigidity can be conferred to the device if additional rods 156 parallel to the axial rod 36, but, preferably not coplanar thereto, are attached to the circular plates 32*c* and 33*c*, as shown in FIG. 5*b*.

Figure 5C:
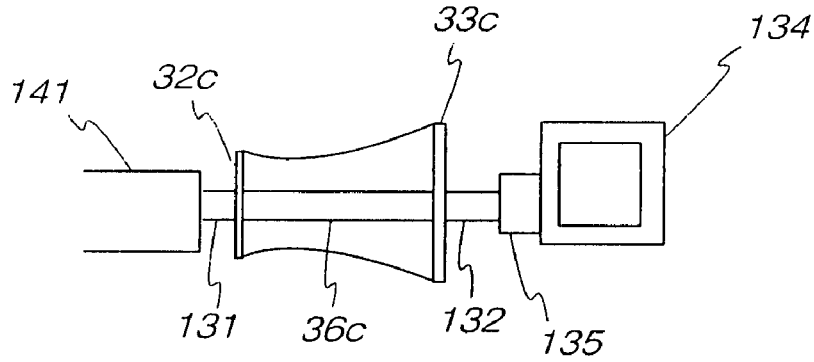
FIG. 5*c* is a schematic view of another alternative embodiment of a rotary device for abrading, sanding, and polishing curved surfaces, in accordance with features of the present invention.

FIG. 5*c* depicts an alternate embodiment facilitating the use of the invented device in conjunction with a hand-held torque-imparting device. As shown in FIG. 5*c*, a first end 131 of the axial shaft of the device 36*c* is engaged in the chuck 141 of a torque-imparting device while the second end 132 of the axial shaft 36*c* is held in rotatable communication with a handle 134 by means of a ball-bearing 135 or other similar device. This alternative embodiment allows a tool user to apply higher and more even abrading pressure. This alternative embodiment can be modified when the invented device is used in conjunction with a fixed torque-imparting machine, such as a lathe, with the first end 131 of the shaft 36*c* being engaged by the chuck of the lathe and the other end 132 being held in rotatable communication with a support. Also the rotation of the device can be supplemented with vibratory motion.

Figure 5D:
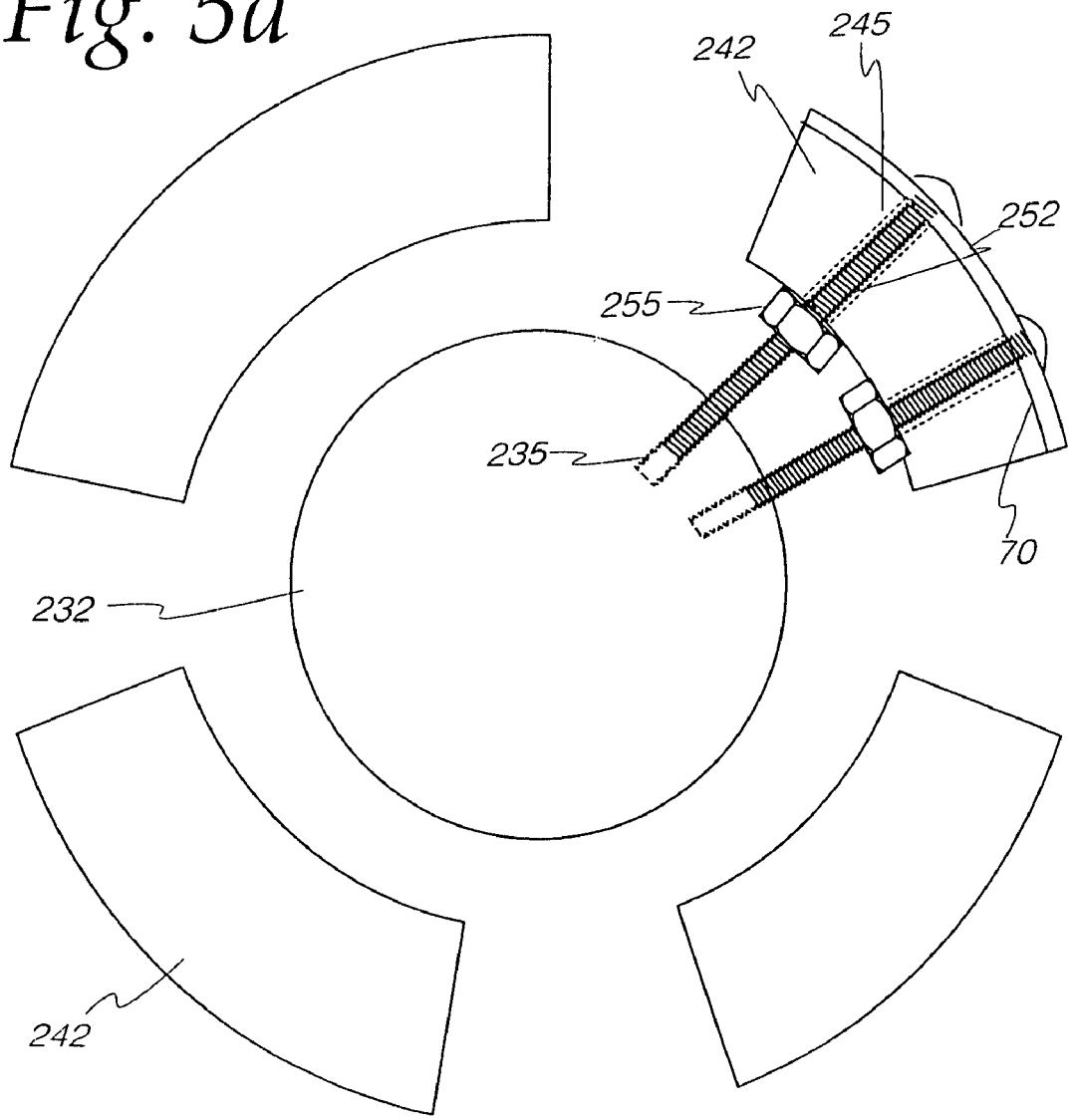
FIG. 5*d* is a schematic view of another alternative embodiment of a rotary device for abrading, sanding, and polishing curved surfaces, in accordance with features of the present invention.

FIG. 5*d* depicts an alternative embodiment wherein the radius of the support plate 32*c* (or 33*c*, or both) is continuously adjustable. As shown in FIG. 5*d*, the support 32*c* comprises a circular plate 232 and a plurality of arcuate segments 242 concentric to and coplanar with the plate 232. The circular plate 232 defines a plurality of screw-threaded radial bores 235 therein and the segments 242 each define two or more clear radial bores 245, with each bore 235 collinear with a corresponding bore 245 so that the plate 232 and the segments 242 are attached to each other by means of screws 252 and nuts 255. The heads 257 of the screws 252 may be used to secure abrading membrane strips 70 (See infra, in connection with FIG. 8) to the outer periphery 244 of the of the segments 242 or they may be countersunk in the segments 242 (not shown).

In general, one or more rods each comprising a first end and a second end and a threaded mid-section are utilized in a rotary abrading device. Two plates are secured to said rods a distance apart by threaded nuts received by said threaded mid-sections. Finally, a membrane coated with abrading material is removably attached to said plates. A centrally-located rod is adapted to be received by a rotating chuck so as to impart high RPM functionality to the device.

Spring-Biased Embodiments.

The invented sanding and polishing device can be improved by the addition of biasing springs so as to allow lateral and medial movement of the plates relative to each other during sanding and polishing operations. This is in addition to the action already conferred by the device whereby the plates are simultaneously rotated or moved linearly in the same direction and speed. Throughout this disclosure, the term "spring" denotes a structure that changes configuration under stress but returns to its original configuration after the stress is removed, including coiled wires, bellows, accordion shaped metal or plastic members, etc. . . .

FIG. 6*a* depicts an embodiment wherein one or more springs 80 are placed between the plates 31 and 32. Nuts 82 and 83 limit the maximum length of the springs and nuts 84 and 85 the minimum length thereof.

FIG. 6*b* depicts an embodiment wherein springs 86, 87 are placed between the plates 31 and 32 and nuts 88 and 89 that limit the separation S between the supports 32, 33. The embodiments depicted in FIGS. 6*a* and 6*b* can be used with either the linear device 10A or the rotary device 10B.

Figure 6C:
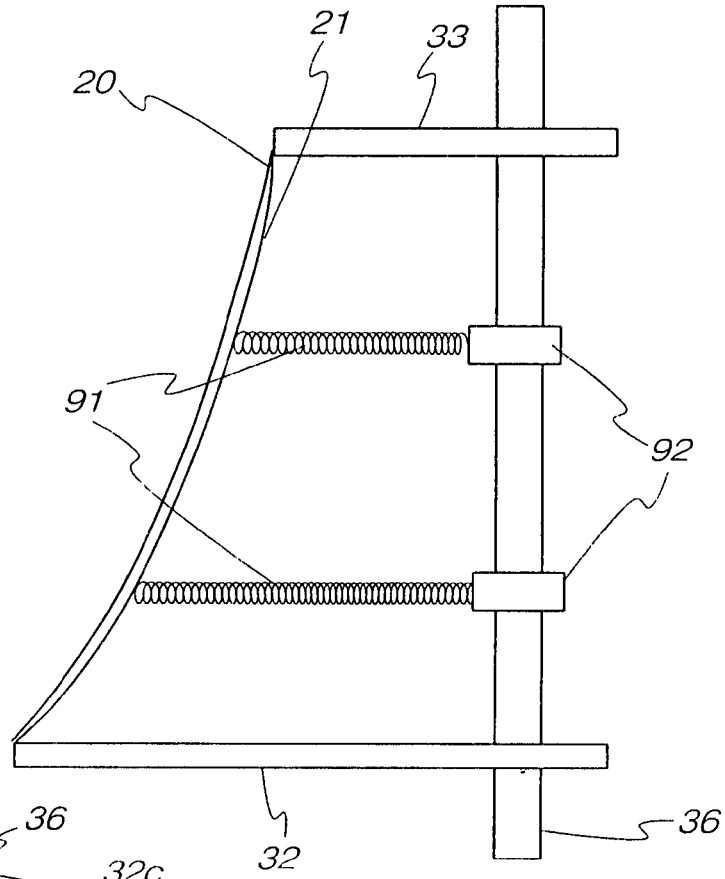
FIG. 6*c* is a schematic view of another alternative spring biasing arrangement for a device for abrading, sanding, and polishing curved surfaces, in accordance with features of the present invention.
Figure 6D:
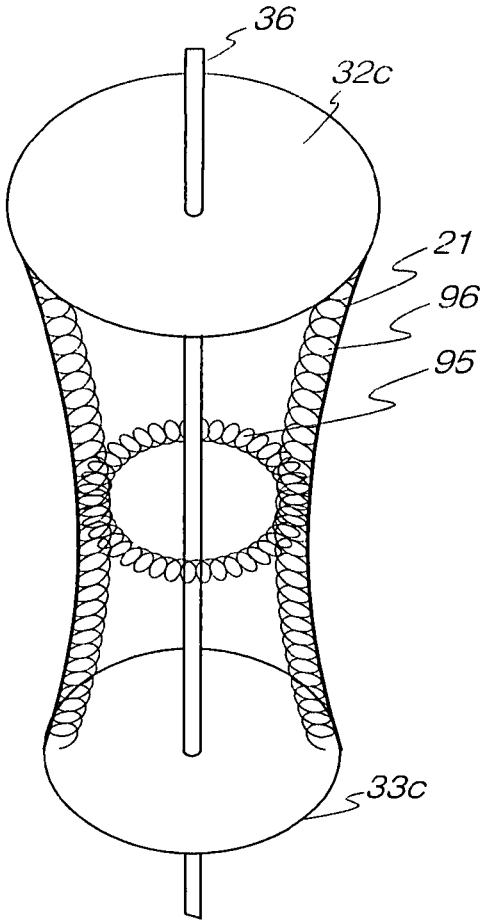
FIG. 6*d* is a schematic view of another alternative spring biasing arrangement for a rotary device for abrading, sanding, and polishing curved surfaces, in accordance with features of the present invention.

Additional spring arrangements are depicted in FIGS. 6*c* and 6*d*. In FIG. 6*c* one or more springs 91 extend from the rods 36 and link the rods 36 with the abrading membrane 20 or the foundation membrane 21. They are attached to the rods 36 by means of rings 92 or bearings that are in rotatable communication with the rods 36. This arrangement can be used with either the linear device 10A or the rotary device 10B.

Depicted schematically in FIG. 6*d* is an arrangement suitable for the rotary device 10B where the abrading membrane 20 (or the foundation membrane 21 supporting the abrading membrane 20) is attached to one or more circular springs 95 concentric with and parallel to the disks 32*c* and 33*c*. Additional springs 96, substantially parallel to the membrane 20, can support the abrading membrane 20 (or the foundation membrane 21 supporting the abrading membrane 20) and link the circular springs 95 to each other and/or to the plates 32*c*, 33*c*. Supporting springs 96 parallel to and supporting the membrane 20 can also be utilized in connection with the linear abrading device 10A.

Figure 6E:
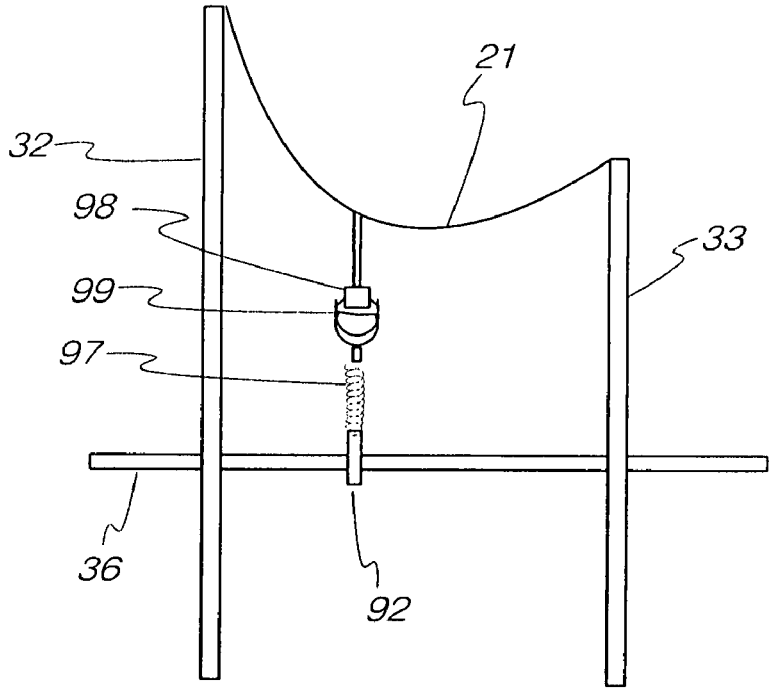
FIG. 6*e* is a schematic view of another alternative spring biasing arrangement for a rotary device for abrading, sanding, and polishing curved surfaces, in accordance with features of the present invention.

FIG. 6*e* depicts an exemplary arrangement of an alternative embodiment wherein the supporting membrane 21 is attached to the rods 36 by one or more tang 98 and yoke 99 flexible coupling mechanisms together with optional springs 97.

Two or more of the spring arrangements illustrated in FIGS. 6*a* through 6*e* can be used in conjunction with each other.

Fabrication Details

Figure 7:
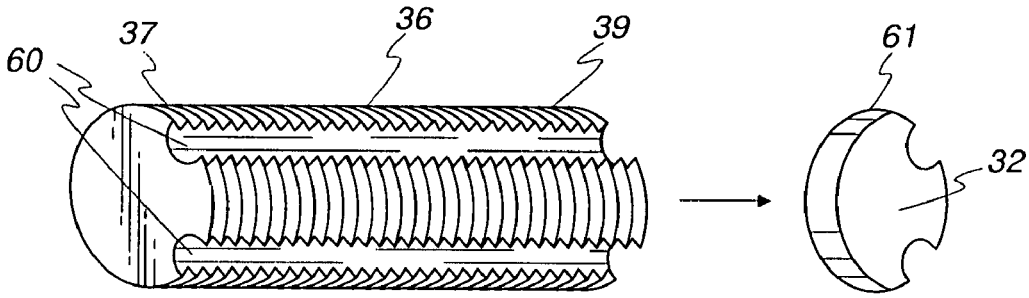
FIG. 7 is a schematic view of a connecting rod for a device for abrading, sanding, and polishing curved surfaces, in accordance with features of the present invention.

Any rigid metallic material is appropriate for the device plates 32, 33 including but not limited to metal, wood, plastic, nylon, fiberglass, or cardboard. Preferably, the one or more rods 36 comprise materials such as steel, wood, plastic, nylon, fiberglass. Preferably, at least the ends 37, 39 of these rods would be capable of being threaded. Optionally, and as depicted in FIG. 7, these rods would have non-circular cross-sections and the plates 32, 33 have cavities 61 through which the rods 36 are snugly received. This arrangement prevents rotation of the plates around the rods 36. Furthermore the rods 36 may comprise one or more channels 60 along the length of the rod so that the position of the securing nuts 35, as depicted in FIG. 4*a*, can be fixed by means of a set screw.

The abrading substrate can be a membrane, webbing, sand paper, rasping material, perforated sheeting, or a plurality of wires. Suitable substrate include, but are not limited to sandpaper, chain male/mesh or sanding cloth, where the abrasive comprises materials such as Aluminum oxide, Silicon carbide, ceramic grains, diamond grains, polishing cloth, fur, etc. . . .

The abrading membrane can be commercially available sandpaper or sanding cloth, where the abrasive comprises materials such as Aluminum oxide, Silicon carbide, Ceramic grains, polishing cloth, fur, etc. . . . The abrading substrate may be attached to the foundational membrane by means of a non-hardening adhesive.

Figure 8:
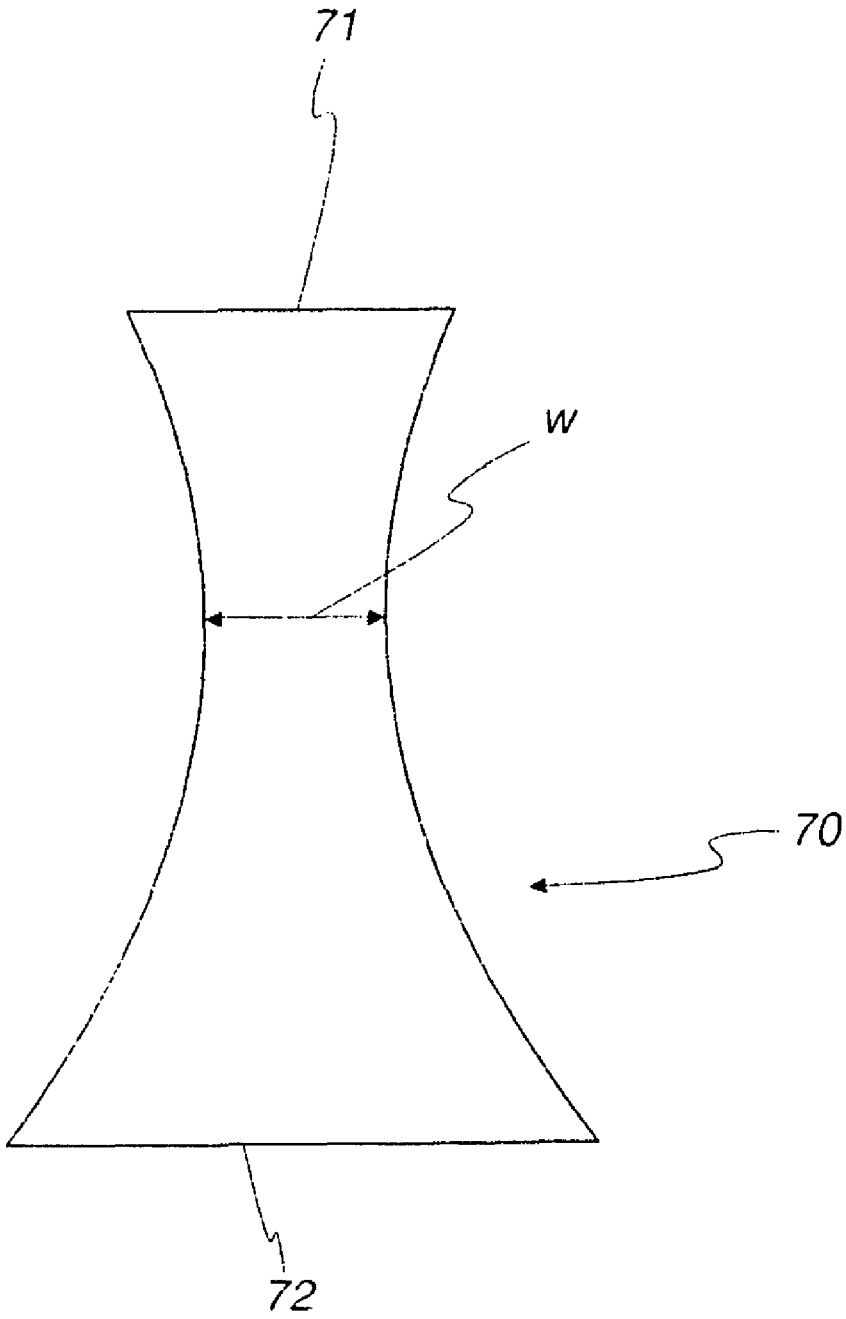
FIG. 8 is a schematic view of a membrane component for a rotary device for abrading, sanding, and polishing curved surfaces, in accordance with features of the present invention.

Single sheets of such materials can be used for the linear trough device 10A. For the rotary device 10B, the above materials can be cut into strips as depicted in FIG. 8, where a strip 70 is depicted with end dimensions 71 and 72 and a width w at its narrowest point such that the dimensions 71, 72, and w constitute the same fraction (say 20 degrees) of the circumferences of the circular discs 31, 32, and of the circumference of the device at its narrowest point. Rectangular strips, rather than a single membrane, may also be used in conjunction with the linear trough device 10A. This arrangement has the advantage that one can replace a single strip that has been torn, rather than having to replace the whole membrane when a tear appears at a single point.

The abrading membrane can be attached to the plates 31,32 by a myriad of means such as screws, hooks, pins, non-hardening adhesive, and a variety of clamping mechanisms. For the linear device 10A, spring clamps are especially indicated while for the rotary device 10B, hose clamps are especially indicated.

While the invention has been described with reference to details of the illustrated embodiment, these details are not intended to limit the scope of the invention as defined in the appended claims.

We claim:

1. An abrading device comprising:

a) a substrate coated with abrading material, wherein the substrate has a first end and a second end, b) a first support attached to the first end;

c) a second support attached to the second end, wherein the second support is movable relative to the first support;

d) a means for imparting motion to the first support and to the second support; and, e) wherein one or more rods transversely intersect the first support and the second support such that the first support and the second support are slidably attached to the rods.

2. The abrading device as recited in claim 1 wherein the substrate is a flexible web and the first and second ends define opposite edges of the web.

3. The abrading device as recited in claim 1 wherein the first support defines a first plane, and the second support defines a second plane positioned parallel to the first plane.

4. The abrading device as recited in claim 1 wherein one or more springs are positioned coaxial with the rods.

5. The abrading device as recited in claim 1 wherein said substrate is attached to said rods by one or more springs.

6. The abrading device as recited in claim 1 wherein the substrate is perforated metal webbing, or wire, or paper, or cloth, or rubber.

7. The abrading device as recited in claim 1 wherein the first and second supports are circular plates.

8. The abrading device as recited in claim 7 wherein said substrate is supported by one or more circular springs defining planes parallel to said plates.

9. The device as recited in claim 1 wherein said substrate is secured to said supports by clamping means.

10. The device as recited in claim 1 further comprising means to impart linear motion to said device.

11. The device as recited in claim 1 further comprising means to impart vibratory motion attached to said device.

12. The device as recited in claim 1 further comprising means to impart rotational motion attached to said device.

13. The device as recited in claim 1 further comprising a foundation membrane supporting said substrate.

14. The device as recited in claim 12 wherein said substrate is attached to said membrane by means of a non-hardening adhesive.

15. The device as recited in claim 1 wherein said rods constitute a non-planar array.

16. The device as recited in claim 1 wherein said substrate comprises a plurality of strips.

17. The abrading device as recited in claim 1 wherein the substrate is attached to said one or more rods by tang and yoke means.

18. The abrading device as recited in claim 1 wherein the substrate is supported by one or more springs substantially parallel to the substrate.

19. The device as recited in claim 1 wherein a) said rods have a non-circular cross-section; and b) said supports have cavities adapted to snugly receive said rods.

20. The device as recited in claim 1 wherein said substrate is attached to one or more said supports at an adjustable distance from said rods.

* * * * *